United States Patent [19]

Miceli

[11] Patent Number: 4,648,145

[45] Date of Patent: Mar. 10, 1987

[54] FOLDING POCKET TOOL AND KNIFE

[76] Inventor: Philip V. Miceli, 1900 Shanklin Ave., Baltimore, Md. 21234

[21] Appl. No.: 479,841

[22] Filed: Mar. 28, 1983

[51] Int. Cl.[4] ..... B26B 11/00; B25F 1/00

[52] U.S. Cl. ..... 7/158; 7/118; 7/142; 7/165; 30/153; 30/255

[58] Field of Search ..... 7/106, 114, 118, 128, 7/142, 158, 165; 30/125, 142, 153, 255

[56] References Cited

U.S. PATENT DOCUMENTS

| | | | |
|---|---|---|---|
| 728,728 | 5/1903 | Kirlin | 7/158 X |
| 2,714,249 | 8/1955 | Clark et al. | 30/153 |
| 3,742,533 | 7/1973 | Brunette | 7/165 |
| 4,097,945 | 7/1978 | Scott | 7/158 X |
| 4,238,862 | 12/1980 | Leatherman | 7/128 |
| 4,287,623 | 9/1981 | Tarran | 7/158 |
| 4,330,937 | 5/1982 | Cope | 30/255 X |
| 4,442,559 | 4/1984 | Collins | 7/158 |

*Primary Examiner*—Frederick R. Schmidt
*Assistant Examiner*—Debra S. Meislin
*Attorney, Agent, or Firm*—John F. McClellan, Sr.

[57] ABSTRACT

A folding pocket tool and knife provides paired handles pivoted to swing around and be held together by a block in either the blade exposed or the folded position, doubly protrusive pivot pins at the handle free ends provide a choice of adjustable spanner wrenches; the knife blade has a tapered wrenching slot, one end-on and two offset screwdriver blades, and has also a hole for wire cutting in conjunction with jaw blades in the handles; toothed members exposed at cutouts in the handles act as jaws of nutcracker-type pliers; sockets in the free ends of the handle and in the block accept and retain standard size, standard shank punches, saws, screwdrivers, wrenches and the like; special blade and handle shapes and economy in blanking parts are also disclosed.

7 Claims, 21 Drawing Figures

FOLDING POCKET TOOL AND KNIFE

FIELD OF THE INVENTION

This invention relates generally to hand-tools and particularly to folding hand tools.

BACKGROUND OF THE INVENTION

Folding knife and tool combinations such as the so-called Swiss Army knife have been known for many years, and so have switch-blade knives and the like.

However, most combination knives suffer from one or more defects to the extent that none has become the standard of commerce for the purposes intended. The defects may include awkwardness or instability in deployment and/or in use, weakness, lack of versatility, expense, undue size and/or weight, corrosion susceptibility, slipperyness in grip, impositiveness in action.

SUMMARY OF THE INVENTION

A principal object of this invention is to provide a combination folding pocket tool and knife system which overcomes prior art deficiencies to the extent that it will become a standard of commerce for the purposes intended.

Further objects are to provide a system as described which provides the user with:

- an easily replaceable, powerful and sharp knife blade with folding, easy-opening paired handle mechanism, and a tapered blade-slot for turning and prying,
- two pivot pins retaining the knife blade,
- a large, strong screwdriver at an end of the paired handle mechanism when the knife is folded, comprising the buttend of the knife blade,
- a pair of offset or right-angle screwdrivers, similarly on the butt end of the knife blade, but on opposed sides thereof;
- a wirecutter with a hole in the butt end of the knife blade also useful for hanging, and operable in coaction with the paired handle mechanism;
- a pair of pliers or nut cracker similarly operable;
- a pair of adjustable distance spanner wrenches providing two diameters of pin size;
- a pivoted handle-locking mechanism with slide action which also serves as a tool block;
- standard socket structure associated with the tool block for detachably holding removable standard bits with integral, standard keys, and also Allen wrenches, Phillips type screwdrivers, drill bits, punches, and all tools of similar types, the standard socket having a modified slot thereacross co-acting with spanner studs for holding a large saw, fish-scaler and the like;
- socket-defining structure along a part of the handle mechanism for holding a standard size sabre saw blade in position for use, with the saw blade retaining against pulling out by a protrusion on the tool block, in co-action with manual squeezing;
- shapes of knife blades and handle blanks adapted for substantially loss-free production from sheet material; and alternative handle adapting the knife blade for other uses.

BRIEF DESCRIPTION OF THE DRAWINGS

The above and other objects and advantages of this invention will become more readily apparent on examination of the following description, including the drawings in which like reference numerals refer to like parts.

FIG. 1A is a detail taken at 1A—1A, FIG. 1, on a larger scale;

DETAILED DESCRIPTION

Figure 1:
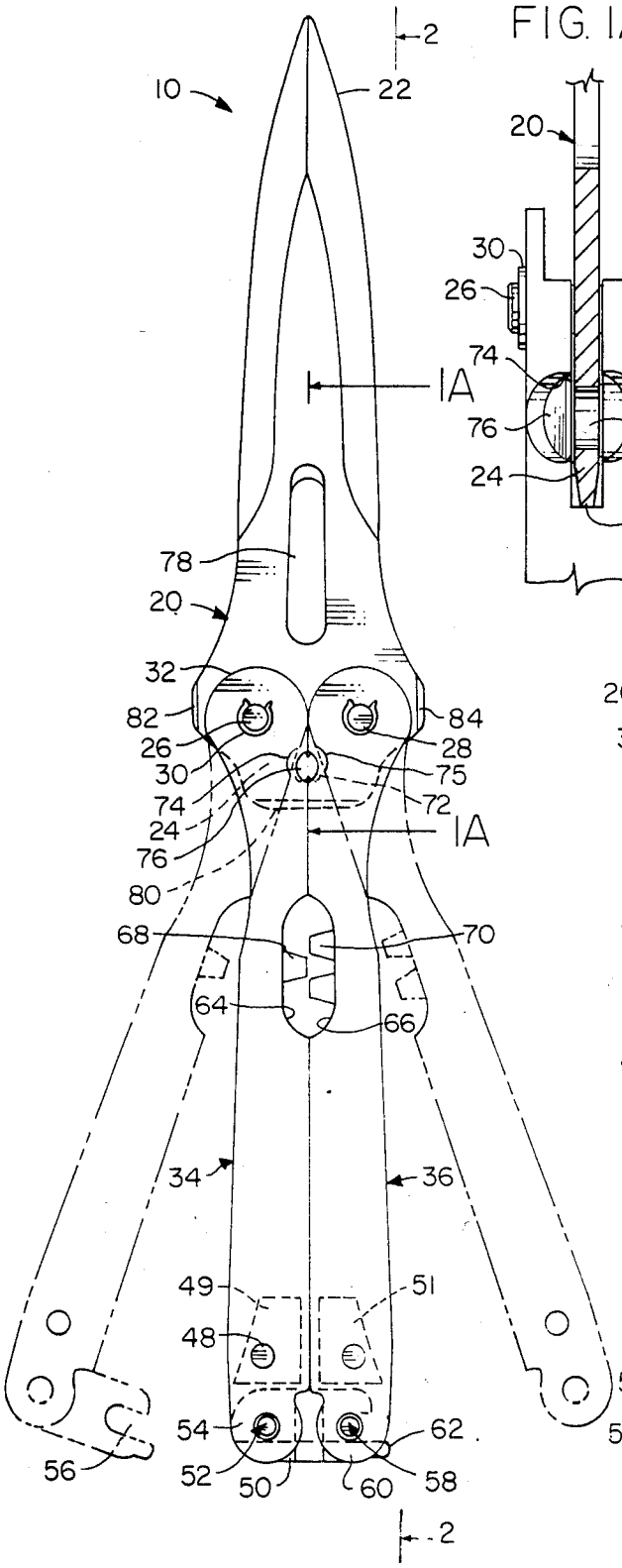
FIG. 1 is a front elevational view showing two operational handle positions (one in broken lines) with blade exposed, of a first embodiment.
Figure 2:
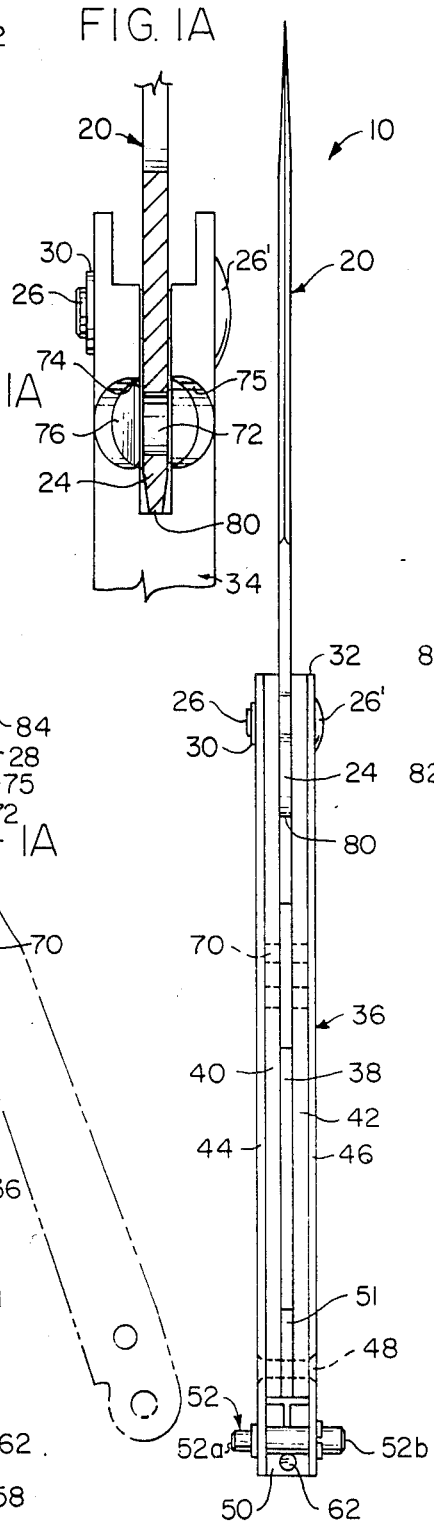
FIG. 2 is a side elevational view thereof taken at 2—2, FIG. 1.

FIGS. 1, 1A and 2 show detailes of embodiment 10 of the invention, a system comprising folding pocket tool and knife.

Blade 20 has a cutting end portion 22 and a butt end portion 24. Means in the form of first and second headed fasteners or pins 26, 28 held by snaprings 30 pivotally connect the first ends 32 of a pair of handles to the blade butt end portion 24. Rivets can be used as permanent fasteners in place of pins 26, 28.

The paired handles, 34 being the first and 36 being the second, receive and cover the blade in respective longitudinal slots 38 (FIG. 2) in the handles when in a first pivotal position. The slots are formed between liners or liner members 40, 42 (FIG. 2) which extend along respective legs 44, 46 of the "U"-section handles. The liners may be held in place by force-fitted pins or rivets as at 48, otherwise conventionally secured. The rivets also retain two blade-centering inserts 49, 51.

In the next pivotal position, shown in full lines in FIG. 1 the handles 34, 36 are in contact and together form a firm, steady, strong grip for the exposed blade. The stored and the exposed-for-use positions are both substantially symmetrical as in handle disposition relative to the blade.

In either the first position or the second(unfolded) position a block 50 or tool block pivotally affixed by a first shouldered pin 52 to the second or free end 54 of the first handle, can hold the handles together. This holding is by detachable engagement of a notch 56 (FIG. 1) in the block free end with a second shouldered pin 58, fixed transversely through the second end 60 of the second handle, parallel with the first shouldered pin. One fork end 62 of the notched end is reduced and rounded for saw blade retention, as will be seen later. The other fork end is shorter to permit holding a saw blade, described later.

To comprise in the assembly a pair of spanner wrenches that are adjustable in span from a minimum of ½ inch (13 mm), each end of the first and second pins may protrude from the handles. The shouldered ends (52*a*, FIG. 2 shown) are smaller in cross-section than the snap-ring held ends (52*b*, FIG. 2 shown) the two diameters providing two spanner jaw sized. As an alternative, only one protrusive end could be used, comprising one spanner, the fixed head being a pan head or a bead similar to that at 26', FIG. 2.

For paired-jaw plier or nutcracker type gripping, each handle has intermediate the length in each arm thereof an opening or cutout 64, 66 on the side opposite the longitudinal slot (38, FIG. 2). Extending along each cutout inside each leg of each handle is a liner protrusion in the form of a toothed member 68, 70. The toothed members of the two handles are opposed so that they can nearly close against each other and the teeth may be staggered.

For cutting wire a circular hole 72 is provided on the centerline of the knife blade 20 for passage of wire therethrough and as a wire-shear jaw for use in conjunction with handle structure. The handle structure includes a clearance aperture 74, 75 in each leg of each handle, and a respective jaw blade 76 formed in the liner structure filling the clearance aperture on one face of the tool only, that is, only one face of the knife blade at hole 72, for severing wire in the hole.

For turning faceted fasteners and prying on headed fasteners, the knife blade which is symmetrical, is provided with a tapered fastener-engaging blade slot 78 along the centerline adjacent the butt-end 24. The forward end of the slot 78 can be sharpened around the arc.

The butt-end 24 has three screwdriver blades on it: at 80 transverse to the butt end, and offset blades 82, 84 opposed on either side of the butt-end. These may be ground to fit any desired sizes of screw-head slots.

Figure 3:
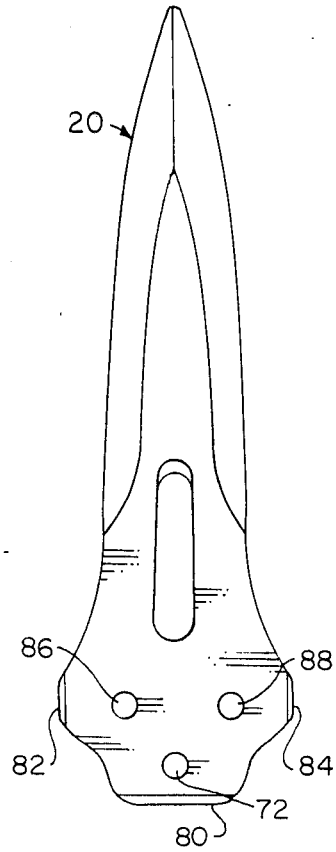
FIG. 3 is a front elevational detail of a knife blade.

FIG. 3 shows details of the blade 20, which may be of any suitable type, hollow-ground double edges leading to a point being shown. Holes 86, 88 are for the handle pivotal fastening means. Hole 72 below the other pair of holes and on the centerline, is for the above described wire cutting provision.

The screwdriver blades sho at 80, 82, 84.

Figure 4:
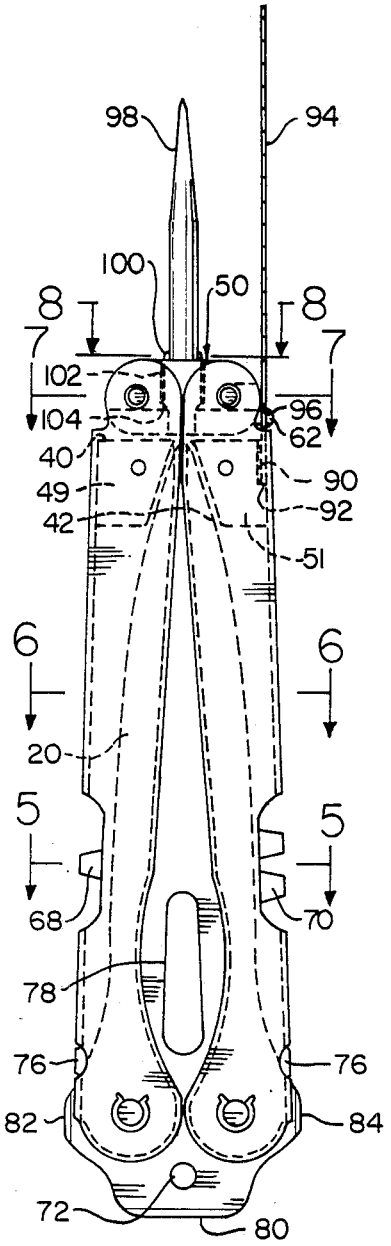
FIG. 4 is a front elevational view with blade folded and two tools held in respective provisions, only one of which tools would normally be used at a time.

FIG. 4 shows the system blade-folded or closed position, demonstrating: accessibility of the screwdriver provisions at 80, 82, 84; typical line extent at 40; blade slot availability in the folded position, at 78; non-slip hand grip provision provided by the toothed member at 68, 70; wire cutting hole 72 and coacting jaw blades at 76; and block 50 holding the handles closed with manual grip.

Additionally, two tool holding provisions are shown; normally only one tool at a time would be used. In blind socket 90 formed by saw blade receiving recess of liner 42 at the handle wall and insert 51; a notched edge 92 forms an end stop for holding a standard saw blade 94 of the type having perforation 96. Inserts 49 and 51 are shown centering knife blade 20. Fork-end protrusion 62 on block 50 fits within the perforation in the saw blade and retains the saw blade as long as the handles are held together. Further, a punch 98 with standard keyed shank 100 is fitted and frictionally held in a key-type socket 102 in the bottom of the block. Instead of a punch, any other tool having this type shank or bit will be held, such as a drill, Allen wrench, Phillips head screwdriver, regular screwdriver, or the like. The usual size of the shank is 3/16 inch (4.5 mm) diameter by 0.050 inch (1.25 mm) thick key extending a total width of ¼ inch (6 mm). The keyway in the socket stops short of passing through the block 50 so that a shoulder 104 limits the fit.

Figure 5:
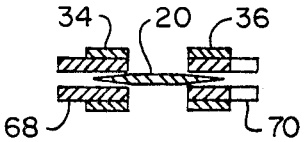
FIG. 5 is a diagrammatic section taken at 5—5, FIG. 4.

FIG. 5 is a cross-sectional diagram showing relation of knife blade 20, liners or liner toother members 68, 70 and handles 34, 36.

Figure 6:
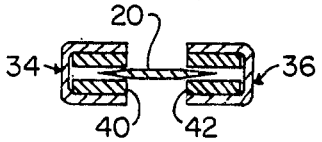
FIG. 6 is a diagrammatic section taken at 6—6, FIG. 4.

FIG. 6 similarly shows blade 20, liners 40, 42 and handles 34, 36.

Figure 7:
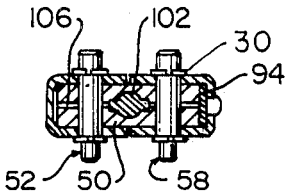
FIG. 7 is a diagrammatic section adapted from 7—7, FIG. 4.

FIG. 7 similarly shows shouldered pins 52, 58, with snaprings 30, keyed socket 102 in block 50, and blade slot 106 communicating across block 50 and the shouldered pins 52, 58 for holding a broad saw blade or a scaler, to be described below.

Figure 8:
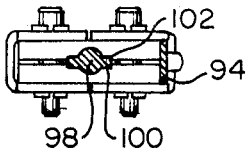
FIG. 8 is an end view adapted from 8—8, FIG. 4.

FIG. 8 shows the end view adapted from 8—8, FIG. 4. Recess 102 receives the keyed shank 100 of punch 98, as also indicated in FIG. 7.

Figure 8A:
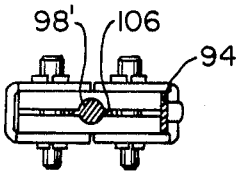
FIG. 8*a* is an end view similar to FIG. 8, but of a modified embodiment.

FIG. 8*a* shows an alternative to the FIG. 8 structure, in which slot 106 is uniform in width all the way across to hold tool 98', similar to tool 98 but with different shank.

Figure 9:
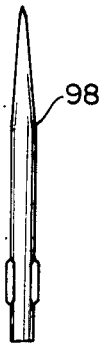
FIG. 9 is a known art or standard tool elevational detail.

FIG. 9 shows an old art standard-keyed-shank punch 98 suitable for use with the invention, as indicated in FIG. 4.

Figure 10:
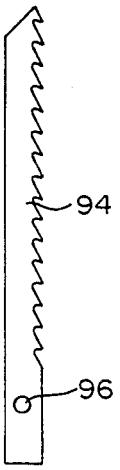
FIG. 10 is a known-art or standard tool elevational detail.

FIG. 10 similarly shows a typical standard "¼ inch" jigsaw blade 94 with perforation 96, suitable for use with the invention as indicated in FIG. 4.

Figure 11:
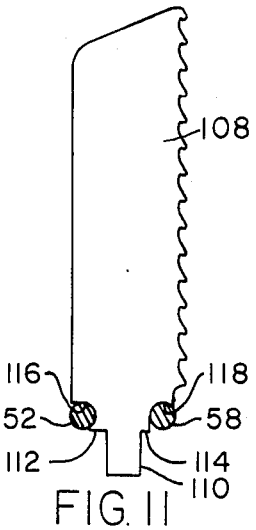
FIG. 11 is an elevational diagram showing special adaptation of a saw-type blade for retention partially by means of structure shown in section.

FIG. 11 shows a modified saw blade 108 with tank 110 at the base extending beyond substantially symmetrical shoulders 112, 114 defining arcuate recesses 116, 118 one of which is longitudinally tangential and the other 116 slightly recessed to form a retaining snap fit with the shouldered pins 52, 58 when in the blade slot (106, FIG. 7), thus axially extending from detachable affixation in the system.

Figure 12:
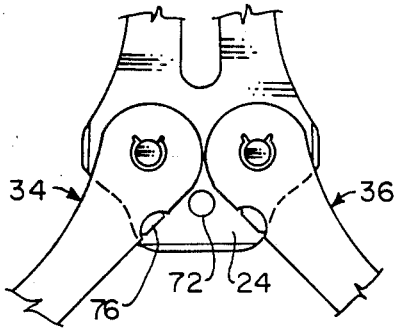
FIG. 12 is an elevational fragmentary detail for wire cutting.

FIG. 12 shows the loading relation of the wire cutting provisions with the handles 34, 36 open, holding the jaw blades 76 to either side of the hole 72 in knife blade butt 24, through which wire is passed.

Figure 13:
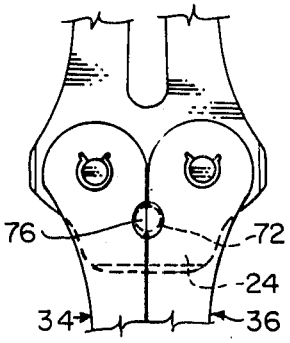
FIG. 13 is a similar detail but of the reverse side and with cutter closed.

FIG. 13 shows the closed or cutting relation of handles 34, 36 and of the jaw blades 76 and hole 72 in knife blade butt 24.

Figure 14:
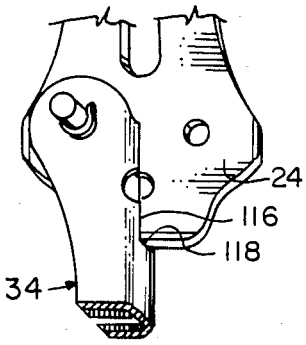
FIG. 14 is a similar detail but in perspective and with one handle removed, for exposition.

FIG. 14 shows how each handle, 34 shown, holds the knife blade butt 24 in a handle notch 116, so that in closed position the end 118 of each handle notch 116 bears on and stabilizes the butt 24 of the knife blade.

Figure 15:
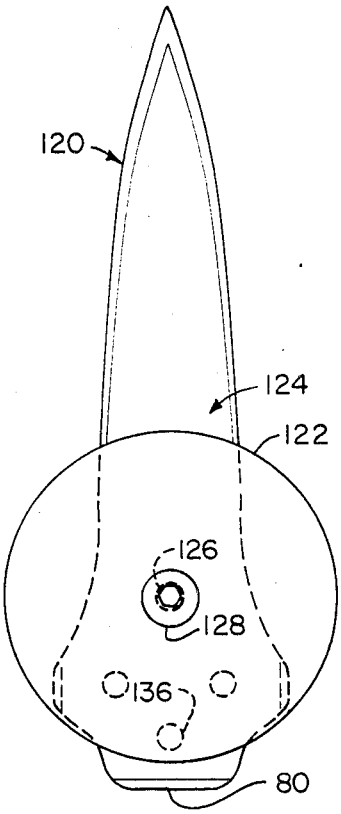
FIG. 15 is an elevational view showing an alternative-handle or second embodiment.
Figure 16:
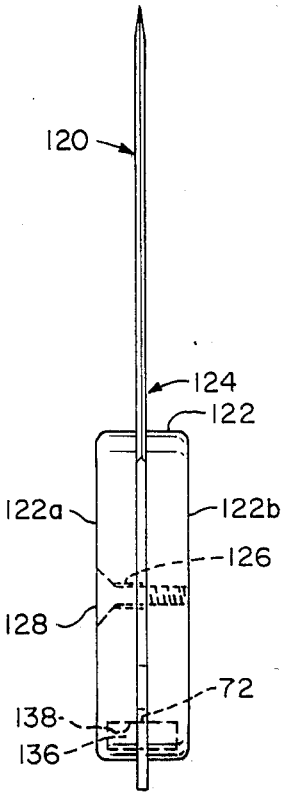
FIG. 16 is a side elevational view of the second embodiment.

FIGS. 15 and 16 show embodiment 120 which ahs a disk-shaped handle 122 which may be used for holding a knife blade 124 similar to blade 20 of the first embodiment except that there is no slot and that there is a fourth hole 126 in diamond pattern in the blade which receives a screw 128 axially joining the radially split halves 122*a*, 122*b* of the circular handle.

A pin 136 is preferably fitted in hole 72 in the knife blade butt, and fits matching recesses 138 in the solid handle. The screwdriver blade 80 may extend outside the handle. If a long blade extension is desired, it is a simple matter to use hole 138 instead of hole 126 by reversing the blade, making the extension longer by the distance between the centers of holes 126 and 138. Pin 136 would then fit hole 126. The flat areas of the disk lend themselves for advertising uses.

Figure 17:
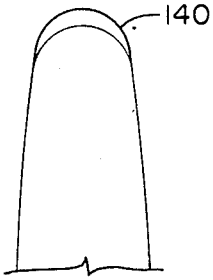
FIG. 17 is a fragmentary detail illustrating a further blade shape.

FIG. 17 shows an oyster-knife type end 140 for a blade otherwise like that of FIG. 16 but particularly suited for use with the disk-shaped handle 122, FIG. 16, for opening oysters or the like.

Figure 18:
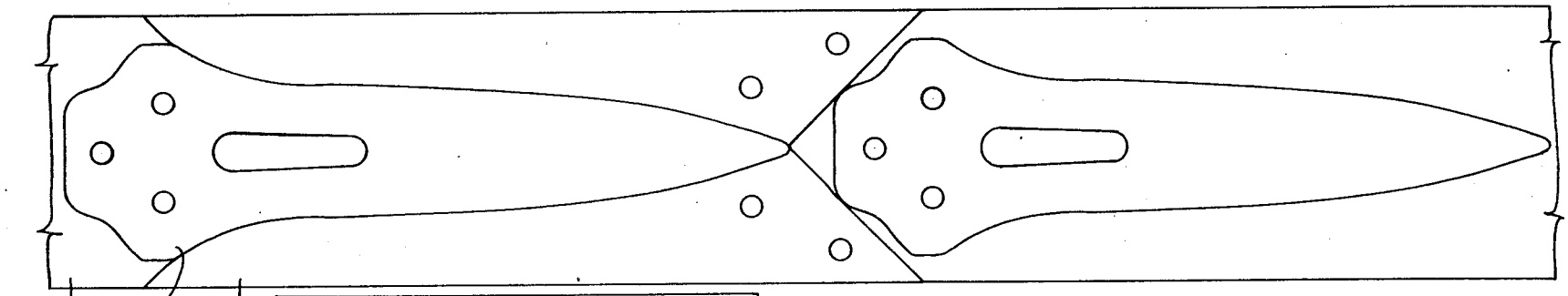
FIG. 18 is a plan view showing layout on a sheet of material for simultaneous production of two types of blade with very little waste.

FIG. 18 shows that in production undue waste can be avoided by stamping out from a strip 14 of material blanks 20' for blades, in nested relation with blades 144 of another configuration. This Figures does not show progressive stages of manufacture but only relative positions. (Either blade 20 or blade 120 can be made with suitable changes in the die.)

Figure 19:
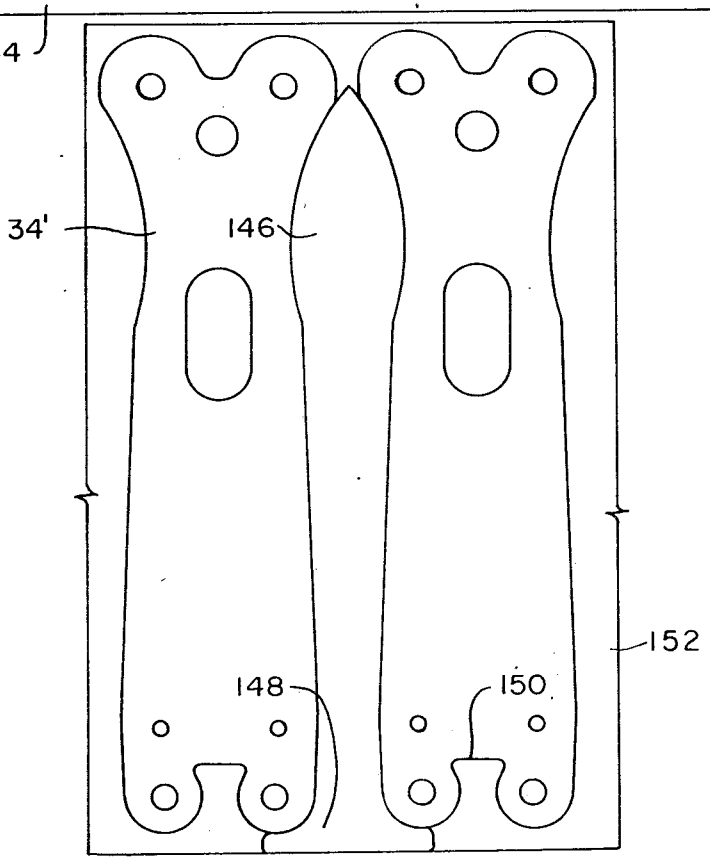
FIG. 19 shows in plan view layout on a sheet of material for simultaneous production of handle blanks alternated with blade blanks of another type of minimize waste.

FIG. 19 shows similar economy in nesting layouts for handle blanks 34', later folded into the handles previously described, with knives 146 that have transverse butt ends 148 so that no handle is actually essential, further saving the material 152.

By using stock width that eliminates the portions below a line across portion 150, and by eliminating the plier and wire cutter clearance holes and by cutting a strip out along the centerline, the two inserts (40, 42, FIG. 2) can easily be made, saving some tool costs.

From the above the advantageous general features of the invention will be evident. In addition, it will be evident that the knife blade taken alone will make an ideal survival tool for military and other users, being easily adaptable as a spearhead or arrowhead using nails or string to secure it. Using two blades secured butt-end to butt-end with a handle at right angles will make a fearsome axe. By adding hooks the blade can be converted to an emergency spoon-type lure for fishing. The blade is well adapted for use with snap-on handles.

Screwdriver blade width can be ¼ inch (6 mm) for the offset screwdriver blanks and ¾ inch (18 mm) for the blade 80.

Knife blade thickness can be 0.090 inch (2.25 mm).

In the saw blade 108, tang width may be 0.187 inch (4.7 mm).

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States letters patent is:

1. In a system of folding pocket tool and knife in combination, including a blade having a cutting end and a butt end, a pair of handles having first and second ends and a respective longitudinal slot in each handle, means pivotally connecting each handle first end to the butt end of the blade with the longitudinal slots opposable for covering the blade cutting end in a first pivotal position of said handles and with the blade exposed and the handles in contact together forming a grip for the exposed blade in a second pivotal position of said handles; the improvement comprising: said pair of handles being a first handle and a second handle substantially similar to the first handle, said means pivotally connecting substantially symmetrically connecting the first and second handles to said butt end of the blade, a block, means pivotally affixing the block to the second end of the first handle, said block having: a free end and means for detachably affixing the free end of the block to the second end of the second handle for selectively holding the handles together in either the first pivotal position or the second pivotal position, said first and second pins having respective first protruding ends proportioned for spanner-wrench use.

2. In a system as recited in claim 1, said first and second pins having respective second protruding ends proportioned for spanner wrench use, said second protruding ends being of different cross-sectional size from said first protruding ends.

3. In a system as recited in claim 1, structure defining a blade-holding slot across said block communicating at the ends thereof with said first and second pins, and a saw blade with a holder portion proportioned for snap fit between said first and second pins in said blade holding slot.

4. In a system of folding pocket tool and knife in combination, including a blade having a cutting end and a butt end, a pair of handles having a first and second ends and a respective longitudinal slot in each handle, means pivotally connecting each handle first end to the butt end of the blade with the longitudinal slots opposable for covering the blade cutting end in a first pivotal position of said handles and with the blade exposed and the handles in contact together forming a grip for the exposed blade in a second pivotal position of said handles, the improvement comprising: said pair of handles being a first a handle and a second handle substantially similar to the first handle, said means pivotally connecting substantially symmetrically connecting the first and second handles to said butt end of the blade, a block, means pivotally affixing the block to the second end of the first handle, said block having: a free end and means for detachably affixing the free end of the block to the second end of the second handle for selectively holding the handles together in either the first pivotal position or the second pivotal position, said block having a bottom, structure defining a key-type socket in said bottom and proportioned for holding respective keyed tool bits such as keyed screwdriver bits and keyed drill bits and the like, therein.

5. In a system of folding pocket tool and knife in combination, including a blade having a cutting end and a butt end, a pair of handles having first and second ends and a respective longitudinal slot in each handle, means pivotally connecting each handle first end to the butt end of the blade with the longitudinal slots opposable for covering the blade cutting end in a first pivotal position of said handles and with the blade exposed and the handles in contact together forming a grip for the exposed blade in a second pivotal position of said handles, the improvement comprising: said pair of handles being a first handle and a second handle substantially similar to the first handle, said means pivotally connecting substantially symmetrically connecting the first and second handles to said butt end of the blade, a block, means pivotally affixing the block to the second end of the first handle, said block having: a free end and means for detachably affixing the free end of the block to the second end of the second handle for selectively holding the handles together in either the first pivotal position or the second pivotal position, said second end of the second handle having a shouldered recess adjacently therealong for detachably holding a perforate saw blade parallel with said second handle and protrusive therfrom.

6. In a system as recited in claim 5, said block having a portion proportioned for protruding into a perforation in a perforate saw blade and retaining a said perforate saw blade in said second handle.

7. In a system as recited in claim 4, said blade having centrally along a portion thereof means for turning and prying a fastener, in the form of a tapered opening through said blade.

* * * * *